US005342274A

United States Patent [19]

Hunker

[11] Patent Number: 5,342,274

[45] Date of Patent: Aug. 30, 1994

[54] MULTI-PURPOSE EXERCISE DEVICE

[76] Inventor: Richard E. Hunker, Westwood Apartments 429 190 16, Frankfort, Ky. 40604

[21] Appl. No.: 986,447

[22] Filed: Dec. 7, 1992

[51] Int. Cl.[5] ..... A63B 23/02

[52] U.S. Cl. ..... 482/140; 482/904; 482/121

[58] Field of Search ..... 482/139, 140, 129, 91, 482/904, 145, 143, 117

[56] References Cited

U.S. PATENT DOCUMENTS

| | | | |
|---|---|---|---|
| D. 209,759 | 1/1968 | Snyder | 482/91 |
| 1,953,857 | 4/1934 | Hunter | 482/140 |
| 1,969,165 | 8/1934 | Turner | 482/129 |
| 2,046,653 | 7/1936 | Petcoff | 482/140 |
| 2,050,652 | 8/1936 | Fleming | 482/140 |
| 4,182,510 | 1/1980 | Lundell | 482/140 |
| 4,185,816 | 1/1980 | Bernstein | 482/140 |
| 4,212,458 | 7/1980 | Bizilia | 482/140 |
| 4,378,939 | 4/1983 | Wild . | |
| 4,468,022 | 8/1984 | Wu | 482/140 |
| 4,591,148 | 5/1986 | Slater | 482/140 |
| 4,611,805 | 9/1986 | Franklin et al. | 482/129 |
| 4,629,179 | 12/1986 | Bizilia | 482/140 |
| 4,705,270 | 11/1987 | Melton . | |
| 4,733,862 | 3/1988 | Miller | 482/129 |
| 4,809,971 | 3/1989 | Goldish . | |

FOREIGN PATENT DOCUMENTS

| | | | |
|---|---|---|---|
| 0538316 | 6/1922 | France | 482/139 |

*Primary Examiner*—Stephen R. Crow
*Assistant Examiner*—Jerome Donnelly
*Attorney, Agent, or Firm*—Charles R. Wilson

[57] ABSTRACT

An exercise device is a constructed in a manner permitting its use by an individual to perform a variety of upper body and lower body exercises to strengthen and condition body muscles. The device comprises a base having a U-shaped channel dimensioned to fit onto an edge of a door, a set of arch-shaped receptacle members extending from the base, and a set of cords with handles extending from the receptacle members. The arch-shaped receptacle members and cords are used by the individual in accordance with the exercise being performed.

9 Claims, 3 Drawing Sheets

MULTI-PURPOSE EXERCISE DEVICE

This invention relates to an exercise device. More particularly, the invention relates to an exercise device which can be used by an individual for a wide array of exercises to strengthen and condition muscles.

Physical fitness has long been a goal of many individuals of all ages and socio-economic strata. It is well recognized that the human body needs a certain amount of physical activity and exercise to function properly. Many simple exercises are done on a routine basis and include walking, jogging, sit-ups, push-ups, and stretching exercises. Most can be done at home and at any time of the day that is convenient. The fitness enthusiast will have a set routine which is strictly followed. Many exercises require no special equipment or facility. However, there are some fitness enthusiasts who feel the need for various home exercise devices which have appeared on the market in recent years. The devices are many and varied.

Most of the known exercise devices disclosed or currently on the market are for a specific purpose. For example, many devices have been disclosed to aid the individual in doing a series of sit-ups. Reference is made to disclosures in U.S. Pat. Nos. 2,050,652, 4,182,510, 4,378,939, 4,591,148, 4,705,270 and 4,809,971 to exercise devices designed exclusively or at least primarily for sit-up exercises. Such devices utilize a fixed structure found in the home such as a door as an anchor to steady the feet of the user. The devices of U.S. Pat. Nos. 2,050,652, 4,378,939 and 4,591,148 force the individual to keep the legs substantially flat on the floor while performing the sit-ups. More current thinking by physical therapists and others in the field now feel that the legs should be bent at the knees to form an approximate ninety degree angle while performing sit-ups to minimize injury to the back. The devices of U.S. Pat. Nos. 4,182,510, 4,705,270 and 4,809,971 appear to permit the user to bend the legs in the recommended fashion. However, all suffer from complexity of manufacturing or difficulty of use. Additionally, all are very specific for one exercise.

Many individuals, including the fitness enthusiasts are not likely to invest in an item which is specific to one use, especially considering the fact normally the same exercise can be performed without the need for any extraneous equipment. For example, sit-ups can readily be done in a proper fashion provided the individual uses care or enlists the aid of a friend or family member. The lack of exercise versatility of many known devices, considering their discretionary need, accounts for their lack of popularity.

U.S. Pat. No. 4,611,805 also discloses an exercise device to aid the individual in doing sit-ups properly. Additionally, the device is said to be useful in doing other exercises to help trim and tone the upper and lower body. It apparently is capable of converting to a sit-up or chest pull exercise device. It is evident, however, that the device comprises several parts, all of which adds to its cost of manufacture, its lack of durability and its difficulty of use.

There is still a need for an exercise device which is able to overcome drawbacks inherent with known devices. The exercise device must be simple in design for manufacturing reasons and ultimate cost savings to the consumer and must be easy to use. Additionally and most importantly, it must be versatile in how it can be used. That is, it must be capable of being used to aid in a number of difficult body muscle strengthening and conditioning exercises to be of any interest to the user. A device capable of fulfilling the aforementioned objectives has been developed and is described in detail below.

SUMMARY OF THE INVENTION

An exercise device for use by an individual is adapted for aiding the individual in performing a number of exercises to strengthen and condition muscles. The device comprises a base having a U-shaped channel dimensioned to fit along an edge of a door, two arch-shaped receptacle members extending from the base and a set of detachable and adjustable cords with handles extending from the base. The U-shaped channel of the base once positioned on the door edge provides an anchor to aid the individual in a variety of exercises. The arch-shaped receptacle members and cords are used individually or collectively in performing the exercises.

DETAILED DESCRIPTION OF THE INVENTION

The exercise device of the invention is described in detail in the following paragraphs. Its components and mode of contemplated use are described with particular reference to the drawings.

Figure 1:
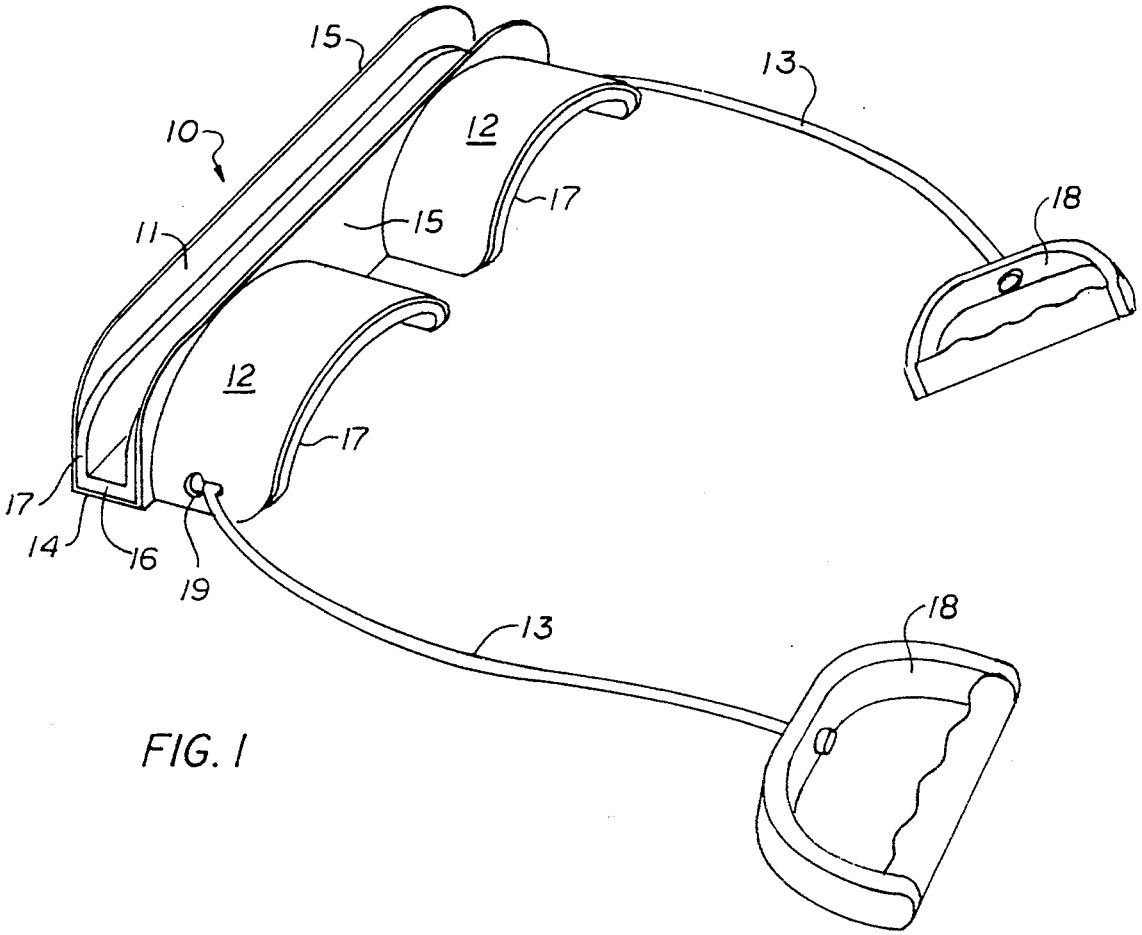
FIG. 1 is a perspective view of an exercise device of the invention.
Figure 2:
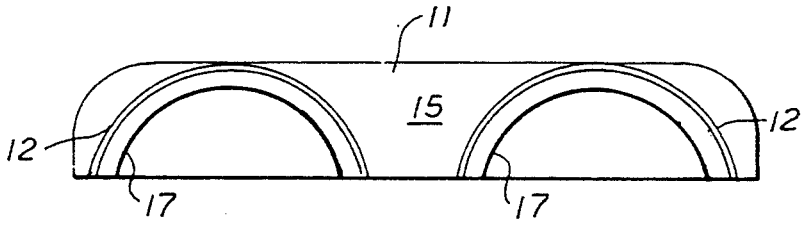
FIG. 2 is a front view of the exercise device of FIG. 1.
Figure 3:
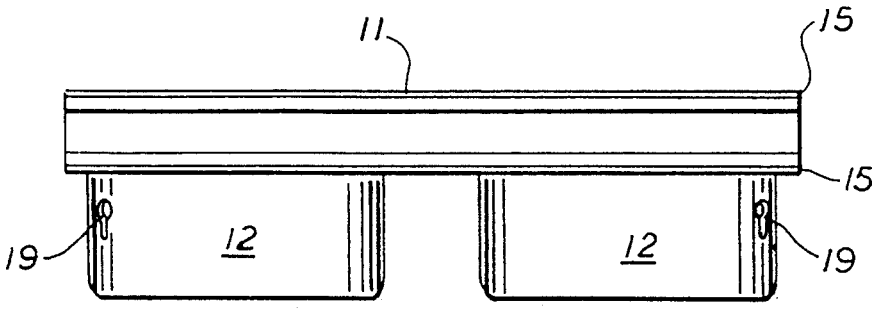
FIG. 3 is a top view of the exercise device of FIG. 1.
Figure 4:
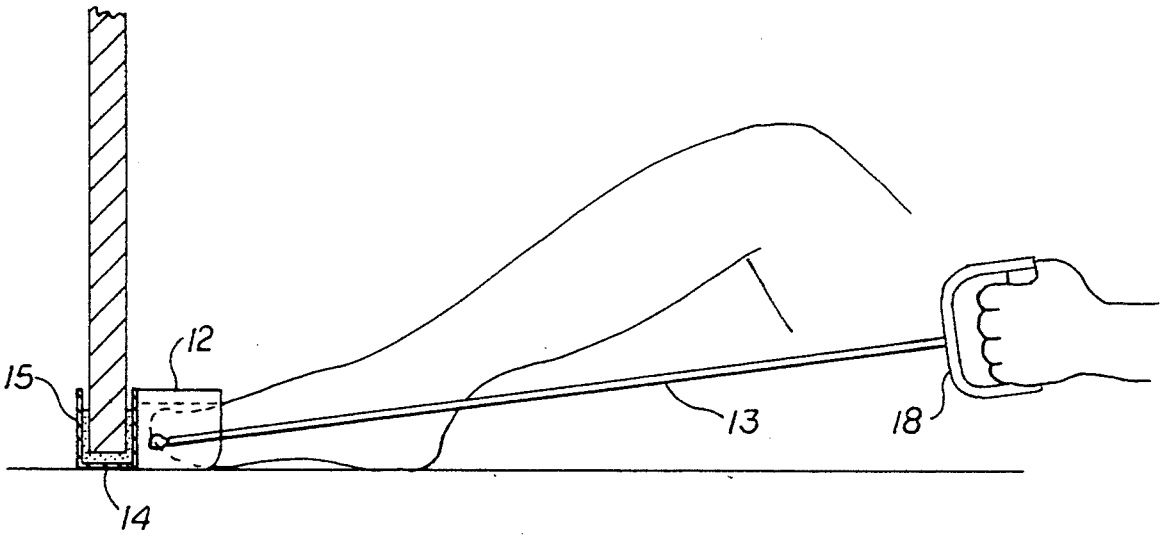
FIG. 4 is an environmental view of the exercise device of FIG. 1 positioned on a door edge and in use by an individual.

With reference to FIGS. 1–3, there is shown the multi-purpose exercise device 10 of the invention. The device has a base 11, arch-shaped receptacle members 12 and cords 13 as its essential components. As will be apparent in the description which follows, the device is peculiarly adapted for use in conjunction with a stationary residential door or office door to aid the individual in performing a variety of exercises designed to strengthen and condition different muscles. By way of illustration only, the exercise device is useful with various lower body exercises and upper body exercises, including sit-ups, pull-ups, chest strengthening, arm strengthening and leg strengthening pull-type exercises.

The base 11 of the exercise device has a U-shaped channel comprised of a bottom wall 14 and side walls 15 dimensioned to fit onto an edge of the door. Once positioned, the base serves as an anchor for use of the device by the individual. The U-shaped channel readily slides onto a free edge of the door and remains there during use. It can fit onto the bottom, side or top edge of the door depending on how the device will be used. Particularly important is the fact the channel of the base does not damage the door during use and permits ready removal of the device from the door when not needed. No special tools or hardware adjustments are needed to either properly position the device on the door or subsequently remove it from the door.

The U-shaped channel of the base ranges from about twelve inches to about thirty inches in length and has a side wall of from about one inch to about four inches in height. The length and height of the channel is not critical, though must provide adequate stability on the door during use. Generally, a channel length of from about eighteen inches to about twenty-four inches is optimum to provide a stable base so that forces are spread over the door edge to minimize damage. The width of the channel is dependent on the width of the door where it will be used. Generally, a channel width of from about two inches to about three inches is adequate.

Optionally, a protective liner 16 is used to line the inside of the U-shaped channel to protect the door on which the exercise device is positioned. Materials such as polymeric foams, woven fabrics and non-woven fabrics are useful for this purpose.

Two arch-shaped receptacle members 12 extend substantially perpendicular from a side wall 15 of the base 11 for receiving the ends of the individual's feet. The receptacle members are preferably equi-spaced on the side wall 15 of the base and are contoured to comfortably receive the feet. Each receptacle member has a depth of from about three to about five inches. The receptacle members are primarily useful in restraining the feet as an aid in doing sit-ups as further described below. Protective liners 17 are also used to optionally line the inside of the receptacle members.

Extending from the arch-shaped receptacle members is a set of flexible cords 13 with handles 18. The cords are removably attached and are used as an aid in doing a variety of exercises. The cords are each about two feet to four feet in length. The handle 18 at one end is provided for ease of use. It can be of conventional shape, including horseshoe shape as shown or preferably a triangular shape.

As best seen in FIG. 1, a key hole notch 19 is provided in each arch-shaped receptacle member to receive an end of a cord. The end of the cord inside the receptacle member is knotted so as to be retained in the narrow portion of the notch. The location of the knot on the cord is used to acquire the cord length desired and needed in accordance with the individual user and particular exercise.

Inelastic cords such as ropes made of natural or synthetic materials can be used. Preferably, however, the cords are made of an elastomeric material which stretches during use. Such cords add to the versatility of the exercise device in that a whole series of stretching type exercises are now possible. Either type of cord, though, is of use in this invention. It is possible, also, to include two or more sets of cords with differing lengths and/or tensions as part of the exercise device to further increase its versatility during use.

Figure 5:
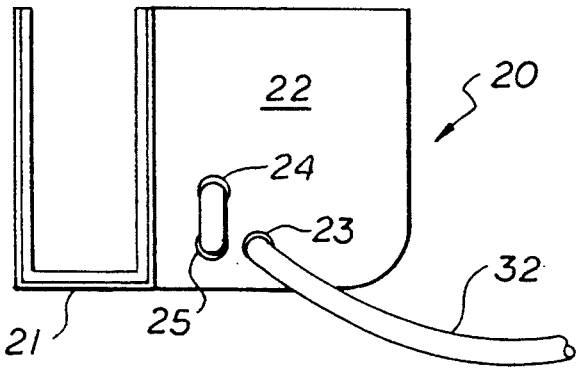
FIG. 5 is a side view of another exercise device of the invention showing an alternative means of holding the cords of the device to its arch-shaped receptacle members.
Figure 5:
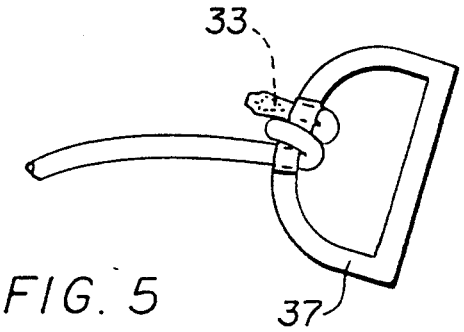
Figure 6:
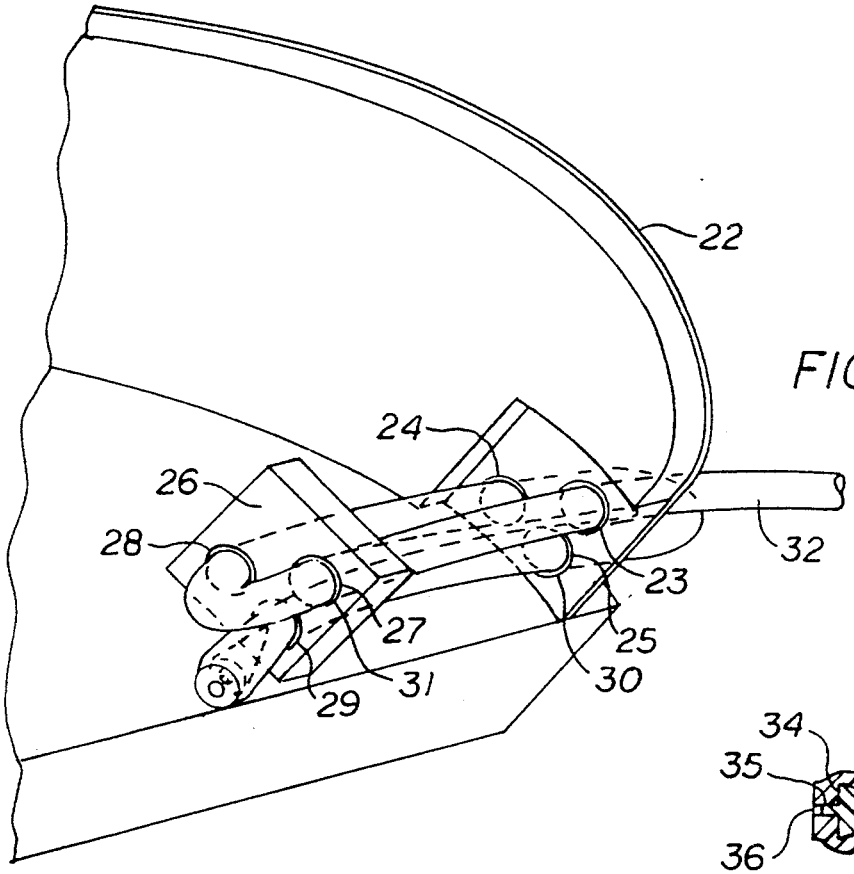
FIG. 6 is a partial perspective view of the exercise device of FIG. 5 showing the inside of the arch-shaped receptacle member where the cord enters a wall thereof.
Figure 7:
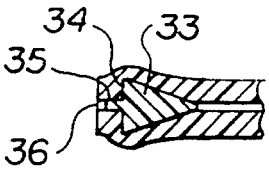
FIG. 7 is a perspective view of a plug used in the end of the cord shown in FIG. 6.

FIGS. 5 and 6 show an alternative means of holding the cords to the arch-shaped receptacle members of the exercise device. The exercise device 20 has a base 21 and arch-shaped receptacle members 22 as in the exercise device 10 described above. As evident in FIG. 5, holes 23, 24 and 25 are provided in the arch-shaped receptacle members 22. Additionally, as evident in FIG. 6, a plate 26 with holes 27, 28 and 29 is positioned on the inside of the receptacle member such that all the holes are in alignment. Rims 30 around each of the plate holes match with recessed shoulders 31 around each of the receptacle member holes to provide a semipermanent means of retention. The plate is made of plastic and provides smooth hole edges with less cord abrasion. An end of a hollow elastomeric cord 32 is threaded through the receptacle first hole 23 and plate hole 27, back through the plate hole 28 and receptacle second hole 24 and finally through the receptacle third hole 25 and plate hole 29 to form a double loop in the cord's end. The cord can be knotted to vary its length as desired. Preferably, as best seen in FIGS- 6 and 7 a plug 33 in the end of the hollow elastomeric cord 32 prevents the end from passing through the holes. The plug 33 is bullet-shaped with a shoulder 34 having a maximum diameter greater than the diameter of the holes- A neck 35 extends from the shoulders. The plug 33 is hollow and the hole 36 in the neck is for ease of manufacturing reasons. The loop in the cord together with the plug provides an attachment means which is easy to assemble and durable during use.

The aforedescribed plug can also be used to hold an end of the cord 32 in a handle 37 at its end. The handle 37 has two holes which extend through a side wall. The cord is threaded through the holes in a looping fashion and the plug inserted- The length of the cord 32 is adjusted at this end if desired by adjusting the cord position in the two holes until the desired length is obtained, up to a maximum length when the plug 33 in the cord end abuts up against the handle.

Figure 8:
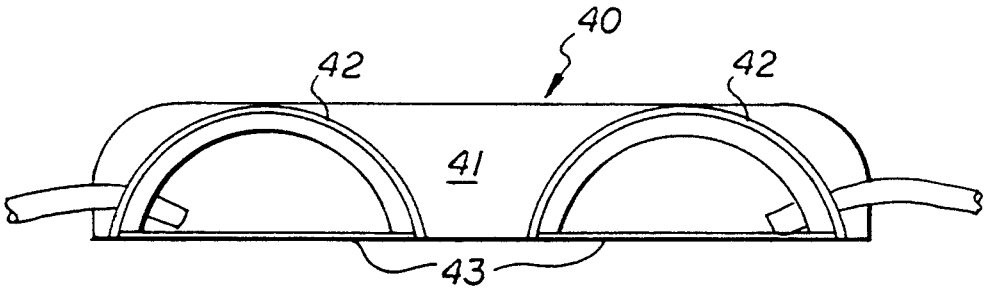
FIG. 8 is a front view of still another exercise device having optional foot plates added.

FIG. 8 shows an optional embodiment of the invention. An exercise device 40 with a base 41 and arch-shaped receptacle members 42 as aforedescribed has a foot plate 43 added to each arch-shaped receptacle member 42 to provide added stability to the device during certain exercises. Each plate is permanently attached to wall terminuses of the arch-shaped receptacle member to form a bottom wall. The plates 43 are of benefit in those exercises where the individual uses the device in a stand-up position as discussed further below. Thus, by standing on the plates, the exercise device is given more stability against movement.

In operation, the exercise device of the invention is first positioned on a free edge, e.g. a bottom edge of a door by sliding the U-shaped channel of the device along the door bottom until completely on the door. The door is next ideally closed until it latches to hold it stationary. The individual now adjusts the cord length depending on the exercise about to be performed. For example, if a series of sit-ups are to be done, the cord lengths will be adjusted to the length where the arms of the individual are best able to aid in lifting the torso at a point optimum to reduce strain in the back. The individual positions the front portion of his feet into the arch-shaped receptacle members, bends his knees at an approximate ninety degree angle, and commences with the sit-ups with the aid of the cords. Arm and shoulder strengthening exercises can also be performed while the exercise device (with elastomeric cords) is on the bottom edge of the door. This is accomplished by the individual standing with his back adjacent the door. The cords are stretched and consequently provides tension when the individual pulls the cords upwardly.

The exercise device is also useful for strengthening the individual's chest muscles. For this exercise, the device is positioned on a top edge of the door and the door closed. Again, the cord lengths are adjusted with the individual's back to the door to provide tension in the chest muscles when the cords are pulled downwardly. Still other muscle strengthening and conditioning exercises are possible including pull-type exercises designed to use forearm, thigh, etc. muscles.

While the invention has been described with particular reference to the drawings, it should be understood various structural modifications can be made to the exercise device. All such modifications of an obvious nature are considered within the scope of the appended claims.

I claim:

1. An exercise device for use by an individual to strengthen and condition different muscles in a variety of exercises, said device comprising:

(a) a base for ready positioning on a door in a manner which provides a secure anchor for use of the exercise device without structurally damaging the door, said base having a U-shape channel dimensioned to slide along a free edge of the door;

(b) two arch-shaped receptacle members extending from the base, each said receptacle member having three holes near an outside edge thereof through which a cord can pass and wherein said receptacle member is capable of receiving a front portion of the individual's foot to restrain it during selected exercises;

(c) two plastic plates, each said plastic plate being positioned on an inside surface of each receptacle member, wherein each said plastic plate has a set of holes which are in alignment with the holes in the receptacle member such that the plate serves to protect the cord from abrasive ware and the holes are used to receive the cord end in a looping manner to temporarily hold the cord end during use of the exercise device; and (d) two flexible cords, each said cord being removably attached to each arch-shaped receptacle member, wherein each said cord has a handle at a terminus for gripping by the individual and serving as an aid in performing an exercise.

2. The exercise device of claim 1 wherein each cord is made of an elastomeric material and has a hollow interior and further has a plug positioned into the hollow interior at a terminus, said plug having a maximum diameter greater than the diameter of a hole through which it passes such that when the plug is positioned int eh terminus of the cord said cord is prevented from being inadvertently pulled through the hold during use.

3. The exercise device of claim 1 wherein each handle has a generally triangular shape with at least one side of sufficient width to permit the individual's hand to wrap around it.

4. The exercise device of claim 1 wherein each cord is from about one foot to about three feet in length.

5. The exercise device of claim 1 wherein the U-shaped channel of the base has a length of from about twelve inches to about thirty inches an a height of from about one inch to about four inches and each arch-shaped receptacle member extend from about three inches to about five inches from the base.

6. An exercise device for use by an individual to strengthen and condition different muscles in a variety of exercises, said device comprising:

(a) a base for ready positioning on a door in a manner which provides a secure anchor for use of the exercise device without structurally damaging the door, said base having a U-shaped channel dimensioned to slide along a free edge of the door and further wherein the U-shaped channel is lined with a protective liner to protect said door form damage;

(b) two arch-shaped receptacle members extending from the base, wherein each said receptacle member is lined with a protective liner and each said receptacle member is capable of receiving a front portion of the individual's foot to restrain it during selected exercises, further wherein each receptacle member has substantially flat plate extending between the ends of its walls to provide a platform for the individual to stand on to further steady the device on the door when the device is used as an aid in doing exercises in a stand-up position; and (c) a set of flexible cords attached to the arch-shaped receptacle members, each of said cords having a handle at a terminus for gripping by the individual and serving as an aid in performing an exercise.

7. The exercise device of claim 6 wherein each arch-shaped receptacle member has a key hole notch at an outside edge thereof to detachably receive an end of one of the cords.

8. The exercise device of claim 6 wherein each arch-shaped receptacle member has three holes near an outside edge thereof to detachably receive an end of one of the cords an a plastic plate with matching holes positioned on an inside surface of the receptacle member such that the holes of the plate are in alignment with the holes in the receptacle member, said plate serving to protect the cord from abrasive ware and said holes used to receive the cord end in a looping manner to temporarily hold said cord end during use of the exercise device.

9. The exercise device of claim 6 wherein each of the arch-shaped receptacle members extend substantially perpendicular from the U-shaped channel of the base.

* * * * *